US006848505B2

(12) United States Patent
Richard et al.

(10) Patent No.: US 6,848,505 B2
(45) Date of Patent: Feb. 1, 2005

(54) ALTERNATIVE METHOD TO CEMENTING CASING AND LINERS

(75) Inventors: Bennett M. Richard, Kingwood, TX (US); Michael A. Carmody, Houston, TX (US); Matthew J. Jabs, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 10/354,242

(22) Filed: Jan. 29, 2003

(65) Prior Publication Data

US 2004/0144538 A1 Jul. 29, 2004

(51) Int. Cl.[7] ..... E21B 19/00
(52) U.S. Cl. ..... 166/285; 166/292
(58) Field of Search ..... 166/285, 292, 166/384, 207

(56) References Cited

U.S. PATENT DOCUMENTS

| | | | | |
|---|---|---|---|---|
| 2,945,541 A | | 7/1960 | Maly et al. | |
| 3,385,367 A | | 5/1968 | Kollsman | |
| 3,918,523 A | * | 11/1975 | Stuber | 166/285 |
| 4,137,970 A | | 2/1979 | Laflin et al. | |
| 4,936,386 A | | 6/1990 | Colangelo | |
| 5,195,583 A | | 3/1993 | Toon et al. | |
| 5,964,292 A | | 10/1999 | Hewitt | |
| 2003/0075323 A1 | * | 4/2003 | Vercaemer et al. | 166/277 |
| 2003/0075333 A1 | | 4/2003 | Vercaemer et al. | |
| 2003/0127225 A1 | * | 7/2003 | Harrall et al. | 166/285 |
| 2003/0146003 A1 | * | 8/2003 | Duggan et al. | 166/384 |
| 2003/0173092 A1 | * | 9/2003 | Wilson et al. | 166/387 |

* cited by examiner

*Primary Examiner*—William Neuder
(74) *Attorney, Agent, or Firm*—Steve Rosenblatt

(57) ABSTRACT

A method of sealing casing or liners in a wellbore is described. The stands of casing or liner receive a jacket bonded to the outer surface. Preferably, the jacket is a rubber compound bonded to the outer wall. The formulation responds to well fluids to swell at a predetermined rate. The casing or liner can also be expanded with a swage preferably prior to the onset of significant jacket swelling. Packers and sealing hangers can be optionally added at the extremes of the casing or liner string to further secure against channeling between adjacent formations.

20 Claims, 2 Drawing Sheets

ALTERNATIVE METHOD TO CEMENTING CASING AND LINERS

FIELD OF THE INVENTION

The field of this invention is methods designed to seal casing or liner in a wellbore using techniques involving a sealing material that swells downhole.

BACKGROUND OF THE INVENTION

Traditionally casing and liners have been sealed in the wellbore with cement that is pumped down internally and later displaced out the bottom of the casing or liner and into the annular space between the casing or liner and the wellbore. This procedure is expensive and requires the use of specialized equipment and specially trained personnel. The process is time consuming and the equipment takes up significant space such that in offshore platforms careful logistics are required to make room for the equipment when the cementing job is required. There are also uncertainties as to the distribution of the cement causing concerns of channeling of fluids from one zone penetrated by the casing or liner to an adjacent zone.

In the past, packers that seal tubing to casing using a ring that swells on contact with well fluids have been designed. These packers combined mechanical compression of the ring with the swelling property used to enhance the tightness of the seal. An example of such a packer is U.S. Pat. No. 4,137,970. This patent describes various polymers, gels, and gels prepared from colloidal suspensions to take the place of mechanically compressed rubber to form a chemical seal ring. In water well applications, that generally are very shallow in comparison to a typical oil or gas well, jackets using grout sandwiched between flexible sheets have been wrapped around the casing and lowered into the water in the wellbore. When the water reached the grout, the grout expanded between the flexible sheets to seal the casing. The grout design is not workable for the fluids and temperatures typically seen in oil and gas wells. Additionally, there is a need to allow sufficient time in the swelling to allow time to properly place the casing or liner before significant swelling begins.

The present invention eliminates the cementing process completely. It provides for the stands of casing or liner to be wrapped between the end connections with a rubber sleeve preferably bonded to the tubular. When the sting of casing or liner is run, the rubber slowly swells to seal around the casing or liner. Optionally, the casing or liner can be expanded with a swage to reduce the volume of the annular space around the casing or liner that the rubber sleeve would have to bridge. Optionally, a packer can be placed at the lower end of the casing or liner string and a sealing hanger can be used near the top of the casing or liner string. Different formulations for the sleeves can be used that are responsive to the presence of different fluids or that induce swelling at different rates, depending on the particulars of the installation. Those skilled in the art will further appreciate the scope of the claimed invention from a description of the preferred embodiment and the claims, which appear below.

SUMMARY OF THE INVENTION

A method of sealing casing or liners in a wellbore is described. The stands of casing or liner receive a jacket bonded to the outer surface. Preferably, the jacket is a rubber compound bonded to the outer wall. The formulation responds to well fluids to swell at a predetermined rate. The casing or liner can also be expanded with a swage preferably prior to the onset of significant jacket swelling. Packers and sealing hangers can be optionally added at the extremes of the casing or liner string to further secure against channeling between adjacent formations.

DETAILED DESCRIPTION OF THE DRAWINGS

FIG. 2 is an elevation view of the wellbore before liner insertion;

FIG. 3 is the view of FIG. 2 with the casing or liner run in;

FIG. 4 is the view of FIG. 3 showing the casing or liner being optionally expanded while the jacket is partially compliant; and FIG. 5 shows the casing or liner fully expanded and the rubber completely compliant.

DETAILED DESCRIPTION OF THE PREFERRED EMBODIMENT

Figure 1:
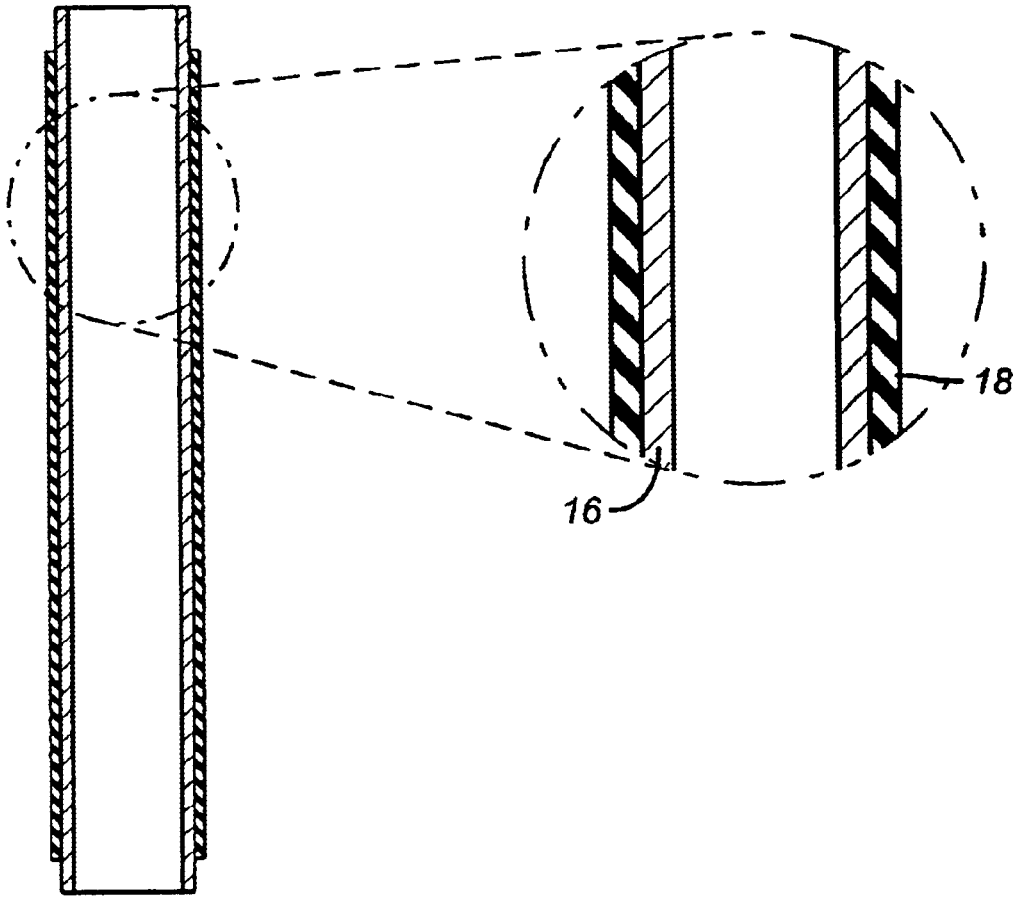
FIG. 1 is a section view of one length of casing or liner showing the jacket mounting in the detailed segment.
Figures 2, 3, 4, 5:
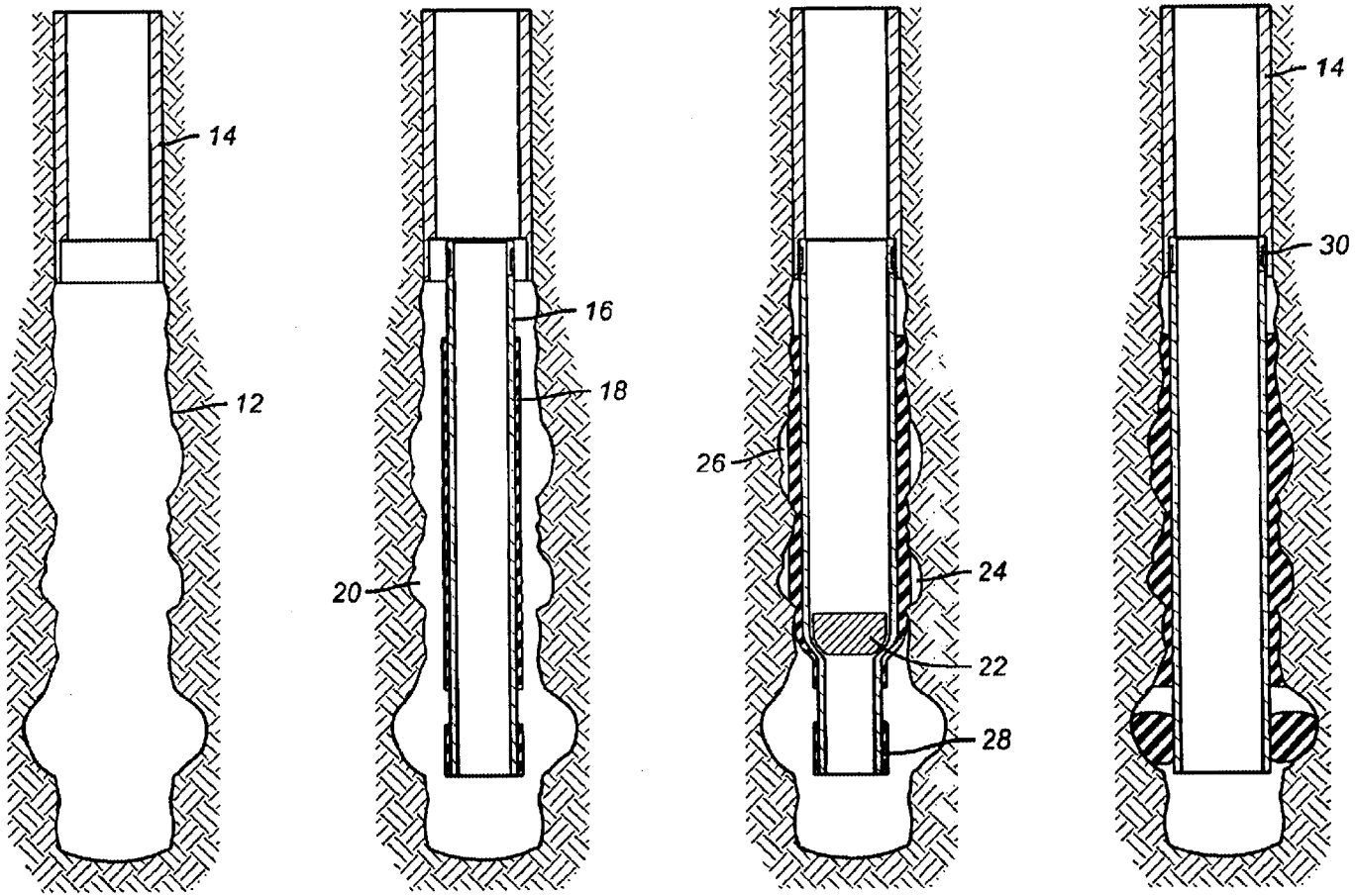

FIG. 1 shows a typical stand of casing or liner 16 in a much longer string that is to be inserted at a desired wellbore location. The wellbore 12 that has already been cased with casing 14 is shown in FIG. 2. FIG. 3 shows the stand of casing or liner 16 inserted into the wellbore and overlapping with casing 14. Depending on the dimensions of the wellbore and the covering 18, the annular space 20 between string 16 and wellbore 12 could be sealed by swelling of covering 18 without physical expansion of the string 16. Optionally, as shown in FIG. 4, a swage, schematically illustrated as 22 can expand the string 16 before the covering has finished swelling and while voids such as 24 and 26 still exist. When the expansion is complete and the swelling stops, FIG. 5 is the way the assembly will look. The string 16 is supported from casing 14 and fully expanded to approximately the same diameter. Alternatively or additionally, a packer or some other annular blocking device 28 can be placed at the lower end to keep the covering 18 from extruding. Additionally, a sealing type hanger apparatus 30 can be placed at the upper end of string 16 to support its weight and to counteract any tendency of the covering 18 to extrude, while swelling. Again, the string 16 can be supported from casing 14 with a hanger such as 30 or equivalent and the covering 18 be designed thick enough to swell and seal annular space 20. Alternatively, the upper end only of the string 16 may be expanded to make circumferential contact to attach it to casing 14 to eliminate use of the hanger 30 and to provide an extrusion barrier.

The covering 18 that can be placed on each joint of the string 16 can be selected to react to oil based mud, water based systems, or, hydrocarbon or salt water production. The swelling rate should be slow enough to allow the string 16 to be assembled and placed in the wellbore 12 at the proper location. The covering for hydrocarbon induced swelling is preferably made of a Nitrile Rubber compound supplied by PolyOne Corp., 150 So. Connell Ave., Dyersburg, Tn., 38024. A typical formulation might be Low CAN Butadiene Acrylonitrile 100, Zinc Oxide 5, Stearic Acid 0.50, Aminox 2, N550 Carbon Black 70, Di-Octyl Sebacate 7.5, Spider Sulfur, 0.50, Vulkacit DM 1, Vulkacit Thiuram 1.25, TETD 1.25, and is preferably bonded to the outer wall of each joint of the string 16. Preferably, when bonded it is a single annular shape with no seams that can allow channeling.

The present invention offers the advantages of easy deployment, prevention of channeling due to the bonded mounting of the covering 18, prevention of premature cement setting inside the string, and use with conventional or expandable casing and liners.

The foregoing disclosure and description of the invention are illustrative and explanatory thereof, and various changes in the size, shape and materials, as well as in the details of the illustrated construction, may be made without departing from the spirit of the invention.

We claim:

1. A method of sealing a tubular string in a wellbore, comprising:

providing a seamless covering on a plurality of stands that make up the tubular string;

running the tubular string to a desired position in the wellbore;

using well fluids to promote swelling of said covering at a rate slow enough to allow placement of said string at the depth desired; and sealing the wellbore from said swelling.

2. The method of claim 1, comprising:

bonding the covering to the stands.

3. The method of claim 1, comprising:

expanding the stands.

4. The method of claim 3, comprising:

performing said expanding before said covering swells completely.

5. The method of claim 1, comprising:

providing extrusion barriers for said covering near at least one extremity of said string; and leaving the ends of said stands uncovered.

6. The method of claim 5, comprising:

providing a combination hanger and extrusion barrier for said covering near an upper end of said string.

7. The method of claim 1, comprising:

overlapping said string with existing well casing;

expanding an end of said string to support it from said existing well casing.

8. The method of claim 7, comprising:

providing substantially circumferential sealing contact between said string and said existing well casing due to said expansion;

using said sealing contact as an extrusion barrier.

9. The method of claim 1, comprising:

making said covering from a material that swells in the presence of one of oil based mud and oil based hydrocarbon production.

10. The method of claim 1, comprising:

making said covering from a material that swells in the presence of one of water based systems and water based production well fluids.

11. The method of claim 1, comprising:

allowing said covering to fill wellbore irregularities due to said swelling.

12. The method of claim 1, comprising:

making said covering from a polymer.

13. The method of claim 12, comprising:

making said covering from rubber.

14. The method of claim 2, comprising:

expanding the stands.

15. The method of claim 14, comprising:

performing said expanding before said covering swells completely.

16. The method of claim 15, comprising:

allowing said covering to fill wellbore irregularities due to said swelling.

17. The method of claim 16, comprising:

making said covering from a polymer.

18. The method of claim 17, comprising:

providing extrusion barriers for said covering near at least one extremity of said string.

19. The method of claim 18, comprising:

providing substantially circumferential sealing contact between said string and said existing well casing due to said expansion;

using said sealing contact as an extrusion barrier.

20. The method of claim 19, comprising:

making said covering from rubber.

* * * * *